US008177578B1

(12) United States Patent
Yang

(10) Patent No.: US 8,177,578 B1
(45) Date of Patent: May 15, 2012

(54) WIRING CONNECTOR

(75) Inventor: Chih-Lin Yang, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/191,439

(22) Filed: Jul. 26, 2011

(51) Int. Cl.
*H01R 13/58* (2006.01)

(52) U.S. Cl. ..... 439/456

(58) Field of Classification Search ..... 439/456, 439/457, 459, 439, 441, 787, 857
See application file for complete search history.

(56) References Cited

U.S. PATENT DOCUMENTS

| | | | | |
|---|---|---|---|---|
| 1,603,884 | A * | 10/1926 | Van Amberg | 439/341 |
| 4,288,655 | A * | 9/1981 | Lass | 174/659 |
| 5,830,006 | A * | 11/1998 | Koumatsu et al. | 439/449 |
| 5,897,392 | A * | 4/1999 | Takahashi et al. | 439/470 |
| 6,478,607 | B2 * | 11/2002 | Tabata | 439/456 |
| 6,648,674 | B1 * | 11/2003 | Dobler | 439/460 |
| 6,773,296 | B2 * | 8/2004 | Kihira et al. | 439/445 |
| 7,044,786 | B2 * | 5/2006 | Nimura | 439/587 |
| 7,285,011 | B2 * | 10/2007 | Hardy et al. | 439/582 |
| 7,540,742 | B2 * | 6/2009 | Hardell | 439/65 |
| 7,722,377 | B2 * | 5/2010 | Moore | 439/341 |
| 7,878,846 | B2 * | 2/2011 | Zhu | 439/541.5 |
| 2006/0148305 | A1 * | 7/2006 | Droesbeke | 439/456 |
| 2011/0263146 | A1 * | 10/2011 | Su | 439/153 |

* cited by examiner

*Primary Examiner* — Tulsidas C Patel
*Assistant Examiner* — Vladimir Imas
(74) *Attorney, Agent, or Firm* — Cheng-Ju Chiang

(57) ABSTRACT

Provided is a wiring connector, including a insulating housing, a wiring contact and a rotary push member. The insulating housing disposes a limiting portion in a receiving cavity and forms and inserting hole on the limiting portion. The wiring contact is mounted in the receiving cavity and includes a clamping portion. The rotary push member is rotatably mounted on the insulating housing and forms a through hole. The rotary push member can be rotated to make the through hole face the inserting hole. One end of the cable can be inserted into the through hole and the inserting hole and be clamped in the clamping portion. The wiring connector can clamp the cable by the clamping portion and fix the cable to the insulating housing by rotating the rotary push member, so that saving the soldering process and enhancing a reliability of connection between the wiring contact and the cable.

7 Claims, 4 Drawing Sheets

WIRING CONNECTOR

BACKGROUND OF THE INVENTION

1. Field of the Invention

The present invention relates to a connector, and more particularly to a wiring connector.

2. Description of the Prior Art

A wiring connector is often used to transmit radio frequency signals. With the microminiaturized and lightweight trend of modern 3C products, electrical components applied thereto are also developed toward smaller lighter and thinner. A prior wiring connector includes an insulating housing and a wiring contact, which is connected to a cable by a connection mode of soldering.

However, the connection of the wiring contact of the prior wiring connector and the cable not only needs a soldering process, but also is easier to be destroyed because the wiring contact is small in size to result in a weak strength. Even the cable is detached from the wiring contact during using so that affecting the transmission of circuit signals.

BRIEF SUMMARY OF THE INVENTION

An object of the present invention is to provide a wiring connector, which can be conveniently connected to a cable and enhance a reliability of connection between a wiring contact and the cable.

To achieve the above object, in accordance with the present invention, a wiring connector is provided. The wiring connector is adapted to be connected to a cable and comprises an insulating housing, a wiring contact and a rotary push member. The insulating housing comprises a front wall, a bottom wall and two sidewalls. The front wall, the bottom wall and the two sidewalls together define a receiving cavity. The insulating housing disposes a limiting portion extending within the receiving cavity, and the limiting portion disposes an inserting hole. The wiring contact is mounted in the receiving cavity and comprises a base plate, a soldering end being bent and extending downward from the base plate, and at least two claws being bent and extending upward from the base plate. These claws constitute a clamping portion, and the clamping portion is corresponding to the inserting hole. The rotary push member is rotatably mounted on the insulating housing and disposes a through hole, and the rotary push member is capable of being rotated to make the through hole be corresponding to the inserting hole. One end of the cable can be inserted into the through hole and the inserting hole and be clamped in the clamping portion, and the cable can be bent by rotating the rotary push member.

Based on the above description, the wiring connector of the present invention can clamp the cable by the clamping portion of the wiring contact and fix the cable to the insulating housing by rotating the rotary push member, so that saving the soldering process and enhancing a reliability of connection between the wiring contact and the cable.

DETAILED DESCRIPTION OF THE PREFERRED EMBODIMENTS

The following embodiment with reference to the accompanying drawings now has been given for detail describing the technology, the feature, the object and the effect of the present invention.

Figure 1:
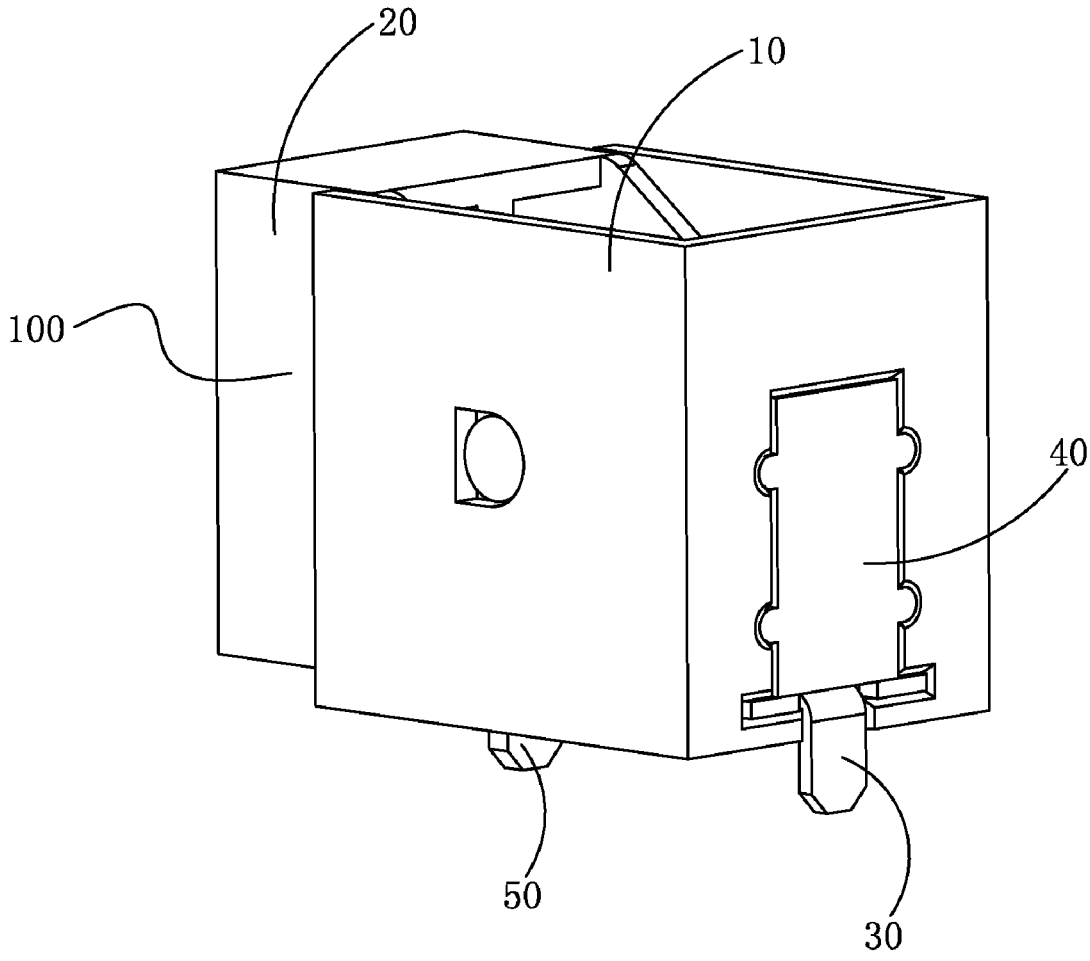
FIG. 1 is a perspective view of a wiring connector according to one preferred embodiment of the present invention.

Referring to FIG. 1, a wiring connector 100 of the present invention is used to be connected to a cable 60 and then be soldered onto a circuit board (not shown). The wiring connector 100 comprises an insulating housing 10, a rotary push member 20, a wiring contact 30, a cover 40 and a retaining member 50.

Figure 2:
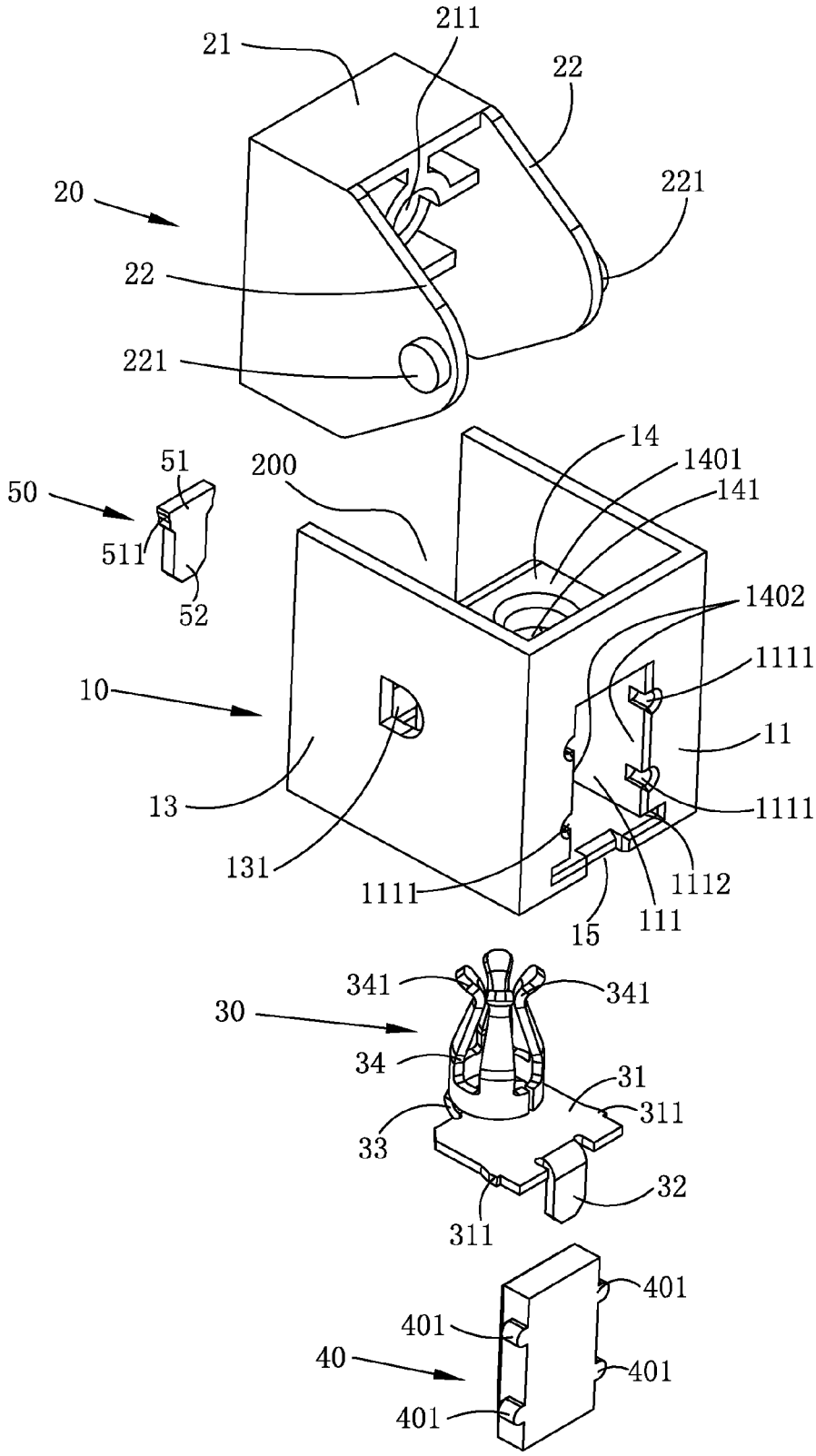
FIG. 2 is an exploded perspective view of the wiring connector of FIG. 1.
Figure 3:
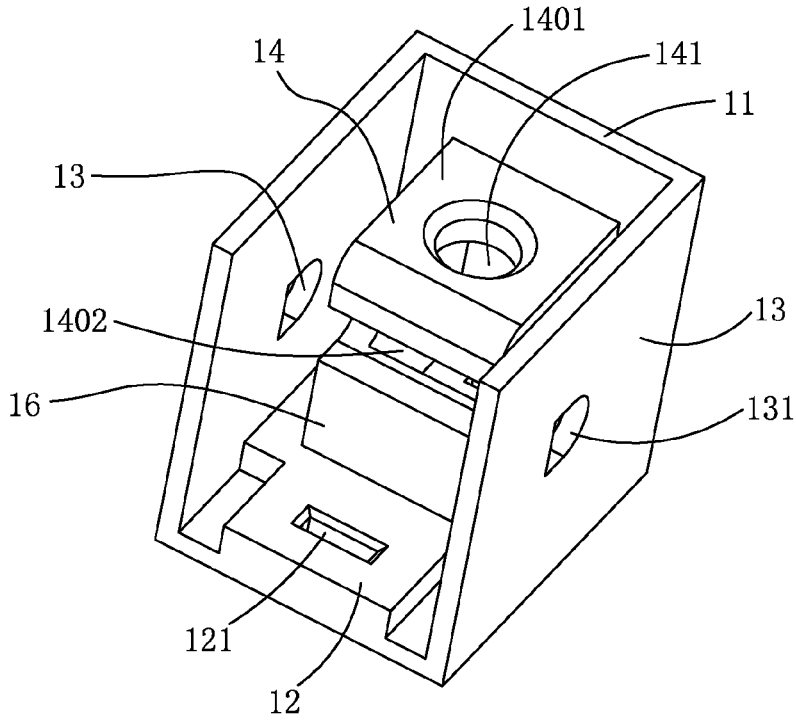
FIG. 3 is a perspective view of an insulating housing of the wiring connector of FIG. 2.

Please refer to FIGS. 2 and 3, the insulating housing 10 includes a rectangular bottom wall 12, a front wall 11 and two sidewalls 13 extending upward from the bottom wall 12. The bottom wall 12, the front wall 11 and the two sidewalls 13 together define a receiving cavity 200. The front wall 11 disposes a mounting opening 111. The insulating housing 10 further disposes a limiting portion 14 extending backward from the mounting opening 111 within the receiving cavity 200. The limiting portion 14 has a top plate 1401 and two side plates 1402 perpendicularly connected to the top plate 1401. The mounting opening 111 disposes several holding grooves 1111 located on two side surfaces thereof and extending to the two side plates 1402 of the limiting portion 14. The mounting opening 111 further disposes a retaining groove 1112 located below the two side surfaces thereof and passing through the below of the limiting portion 14 to extend into the receiving cavity 200. The top plate 1401 of the limiting portion 14 disposes an inserting hole 141 on the middle thereof. The front wall 11 further disposes a recess 15 on a bottom edge thereof. The bottom wall 12 disposes a slot 121 on the middle of the rear thereof, and forms a block wall 16 extending upward for auxiliary limiting the wiring contact 30. Each of the two sidewalls 13 disposes a latch groove 131 generally located on the middle thereof and communicated with the receiving cavity 200.

Please continuously refer to FIG. 2, the rotary push member 20 can be rotatably mounted on the two sidewalls 13 of the insulating housing 10. The rotary push member 20 comprises a connecting body 21 being rectangular plate-shaped, and two extending portions 22 separately extending forward from two sides of the connecting body 21 and generally being sector-shaped. The connecting body 21 disposes a through hole 211 on the middle thereof. Each of the two extending portions 22 disposes a pivot portion 221 being close to a tip end of the sector and protruding outward.

Referring to FIG. 2, the wiring contact 30 can be mounted on the insulating housing 10. The wiring contact 30 comprises a base plate 31, a soldering end 32 being bent and extending downward from the middle of a front edge of the base plate 31, a connecting portion 33 being bent and extending upward from the middle of a rear edge of the base plate 31, and a clamping portion 34 having a plurality of claws 341 and being inward bent from a top edge of the connecting portion 33. The base plate 31 forms at least one barb 311 protruding outward on each of two side edges thereof. One end of the cable 60 can be closely clamped by the design of the claws 341 of the clamping portion 34.

Continuously referring to FIG. 2, the cover 40 is plate-shaped and can be mounted on the insulating housing 10. The cover 40 disposes a plurality of holding portions 401 protruding outward from two side edges thereof. The cover 40 can close the mounting opening 111 and the holding portions 401 are retained in the holding grooves 1111.

Referring to FIG. 2, the retaining member 50 can be mounted on the insulating housing 10. The retaining member 50 comprises a base block 51, and a soldering block 52 extending downward from the lower of the base block 51. The base block 51 disposes at least one protruding barb 511 on each of two side edges thereof.

Please refer to FIGS. 1 to 3, when assembling the wiring connector 100 of the present invention, first, the retaining member 50 is downward inserted into the slot 121 of the insulating housing 10 from the receiving cavity 200 so that forming an interference fit between the protruding barbs 511 and a sidewall of the slot 121, and the soldering block 52 extends downward out of the slot 121. Next, the two extending portions 22 of the rotary push member 20 extend into the receiving cavity 200 from the above of the insulating housing 10 and are located two sides of the limiting portion 14, and the pivot portion 221 enters into the latch groove 131. Now the through hole 211 is corresponding to the inserting hole 141, and the rotary push member 20 can be located on the rear of the insulating housing 10 by counter-clockwise rotating the connecting body 21. Then, the wiring contact 30 is inserted into the limiting portion 14 from the front of the insulating housing 10, wherein the block wall 16 may auxiliary limit the wiring contact 30, two sides of the base plate 31 are retained in the retaining groove 1112 so that forming an interference fit between the barbs 311 and the sidewall of the retaining groove 1112, the soldering end 32 extends downward from the recess 15 and out of the insulating housing 10, and a claw opening defined by the claws 341 of the clamping portion 34 is corresponding to the inserting hole 141. And then, the cover 40 closes the mounting opening 111 and the holding portion 401 is retained in the holding groove 1111 so that fixing the wiring contact 30 in the insulating housing 10.

Figure 4:
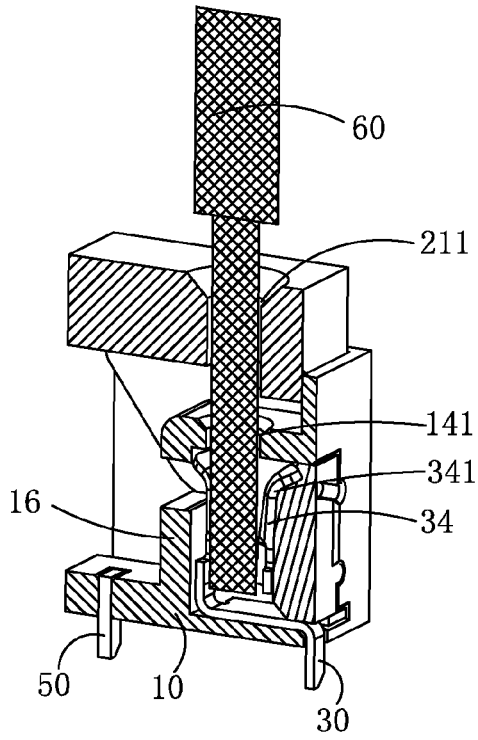
FIG. 4 is a sectional view when a cable is connected to the wiring connector of FIG. 1.
Figure 5:
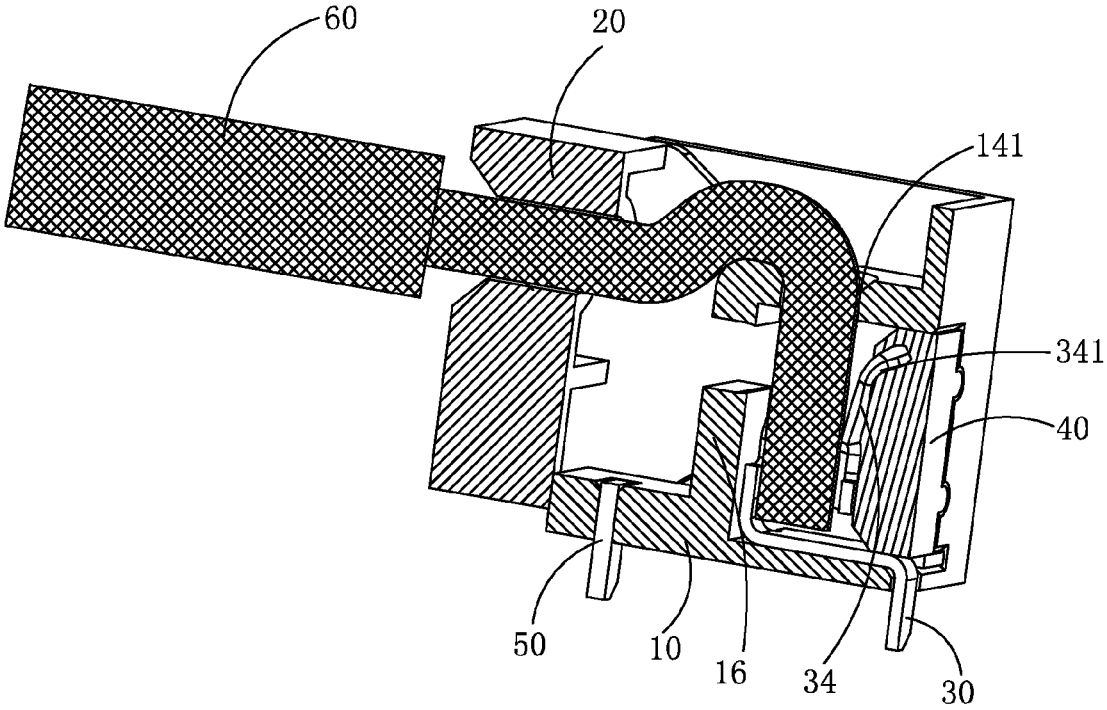
FIG. 5 is a sectional view after rotating a rotary push member of FIG. 4.

Referring to FIGS. 4 and 5, when using the wiring connector 100 of the present invention, one end of the cable 60 passes through the through hole 211 and the inserting hole 141 from the above of the through hole 211 to be clamped into the clamping portion 34 having the claws 341, and then the rotary push member 20 is counter-clockwise rotated to the rear of the insulating housing 10. Now, the one end of the cable 60 is bent and received into the receiving cavity 200 by rotating the rotary push member 20, so that fixing the cable 60 to the insulating housing 10. The wiring connector 100 of the present invention is soldered onto the circuit board (not shown) by the soldering end 32 and the soldering block 52.

As described above, the wiring connector 100 of the present invention can clamp the cable 60 by the claws 341 of the clamping portion 34, and fix the cable to the insulating housing 10 by rotating the rotary push member 20, so that saving the soldering process and enhancing a reliability of connection between the wiring contact 30 and the cable 60.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A wiring connector, which is adapted to be connected to a cable, comprising:

an insulating housing comprising a front wall, a bottom wall and two sidewalls, the front wall, the bottom wall and the two sidewalls together defining a receiving cavity, the insulating housing having a limiting portion extending within the receiving cavity, and the limiting portion having an inserting hole;

a wiring contact being mounted in the receiving cavity and comprising a base plate, a soldering end being bent and extending downward from the base plate, and at least two claws being bent and extending upward from the base plate, these claws constituting a clamping portion, and the clamping portion corresponding to the inserting hole; and a rotary push member being rotatably mounted on the insulating housing and having a through hole, the rotary push member being capable of being rotated to make the through hole in alignment with the inserting hole;

wherein one end of the cable can be inserted into the through hole and the inserting hole and be clamped in the clamping portion, and the cable can be bent by rotating the rotary push member.

2. The wiring connector as claimed in claim 1, wherein the front wall of the insulating housing disposes a mounting opening, on which a cover is mounted for closing the mounting opening.

3. The wiring connector as claimed in claim 2, wherein the cover disposes a plurality of holding portions protruding outward from two side edges thereof, the mounting opening disposes a plurality of holding grooves located on two side surfaces thereof and extending to two side plates of the limiting portion, and the holding portions are retained in the holding grooves.

4. The wiring connector as claimed in claim 1, wherein the bottom wall of the insulating housing forms a block wall extending upward for auxiliary limiting the wiring contact.

5. The wiring connector as claimed in claim 1, wherein each of the two sidewalls of the insulating housing has a latch groove located on the middle thereof and communicated with the receiving cavity; the rotary push member further comprises a connecting body, two extending portions separately extending forward from two sides of the connecting body; each of the two extending portions has a pivot portion being close to a tip end of the extending portion and protruding outward, and the pivot portion is held in the latch groove.

6. The wiring connector as claimed in claim 1, wherein the base plate of the wiring contact forms at least one barb protruding outward on each of two side edges thereof, the mounting opening of the insulating disposes a retaining groove being located below two side surfaces thereof and passing through the below of the limiting portion to extend into the receiving cavity, the front wall of the insulating housing has a recess on a bottom edge thereof, two sides of the base plate are retained in the retaining groove to form an interference fit between the barbs and the retaining groove, the soldering end of the wiring contact extends downward from the recess and out of the insulating housing.

7. The wiring connector as claimed in claim 1, further comprising a retaining member mounted on the insulating housing, wherein the retaining member comprises a base block and a soldering block extending downward from the lower of the base block, the base block has at least one protruding bar on each of two side edges thereof; the bottom wall of the insulating housing disposes a slot on the rear thereof, the protruding barbs forms an interference fit with a sidewall of the slot, and the soldering block of the retaining member extends downward out of the slot.

* * * * *